US009062555B2

(12) United States Patent
Schnieder et al.

(10) Patent No.: US 9,062,555 B2
(45) Date of Patent: Jun. 23, 2015

(54) GAS TURBINE BLADE AND METHOD FOR PRODUCING A BLADE

(75) Inventors: Martin Schnieder, Ennetbaden (CH); Jörg Krückels, Birmenstorf (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 379 days.

(21) Appl. No.: 13/528,013

(22) Filed: Jun. 20, 2012

(65) Prior Publication Data

US 2013/0004332 A1 Jan. 3, 2013

(30) Foreign Application Priority Data

Jun. 29, 2011 (CH) ..... 1093/11

(51) Int. Cl.
*F01D 5/18* (2006.01)

(52) U.S. Cl.
CPC ..... *F01D 5/186* (2013.01); *Y10T 29/49341* (2015.01); *F01D 5/187* (2013.01); *F05D 2260/202* (2013.01); *F05D 2260/22141* (2013.01)

(58) Field of Classification Search
USPC ..... 416/97 R, 95, 96 R, 232, 233
See application file for complete search history.

(56) References Cited

U.S. PATENT DOCUMENTS

| | | | | |
|---|---|---|---|---|
| 3,620,643 | A | 11/1971 | Jones | |
| 5,667,359 | A * | 9/1997 | Huber et al. | 416/96 A |
| 5,702,232 | A | 12/1997 | Moore | |
| 6,254,347 | B1 * | 7/2001 | Shaw et al. | 416/97 R |
| 8,109,725 | B2 * | 2/2012 | Abdel-Messeh et al. | 416/96 R |
| 8,535,004 | B2 * | 9/2013 | Campbell | 416/97 R |
| 2001/0016162 | A1 | 8/2001 | Lutum et al. | |
| 2006/0096092 | A1 * | 5/2006 | Pietraszkiewicz et al. | 416/232 |
| 2008/0166240 | A1 * | 7/2008 | Scott et al. | 416/232 |

FOREIGN PATENT DOCUMENTS

| | | |
|---|---|---|
| EP | 1267040 | 12/2002 |
| GB | 2460936 | 12/2009 |
| JP | 58-17323 B2 | 4/1983 |

OTHER PUBLICATIONS

Search Report for Swiss Patent App. No. 01093/11 (Oct. 7, 2011).
First Office Action issued on Nov. 21, 2014 by the Chinese Patent Office in corresponding Chinese Patent Application No. 201210222050.5, and an English translation thereof.
Office Action (Notification of Reasons for Refusal) issued Jan. 5, 2015 by the Japanese Patent Office in corresponding Japanese Patent Application No. 2012-145907.

* cited by examiner

*Primary Examiner* — Richard Edgar
(74) *Attorney, Agent, or Firm* — Buchanan Ingersoll & Rooney PC

(57) ABSTRACT

A blade (10) for a gas turbine has a blade airfoil (11), the blade wall (18) of which encloses an interior space (17). For cooling the blade wall (18), the blade wall (18) includes a cooling arrangement (19) which has a radial passage (20) extending in the longitudinal direction of the blade and from which a multiplicity of cooling passages (21, 22), extending in the blade wall (18), branch in the transverse direction, and from which a multiplicity of film-cooling holes (23) are led to the outside in the transverse direction. Particularly efficient cooling is made possible by the distribution of the film-cooling holes (23) along the radial passage (20) being selected independently of the distribution of the cooling passages (21, 22) along the radial passage (20).

14 Claims, 4 Drawing Sheets

GAS TURBINE BLADE AND METHOD FOR PRODUCING A BLADE

This application claims priority to Swiss App. No. 01093/11, filed 29 Jun. 2011, the entirety of which is incorporated by reference herein.

BACKGROUND

1. Field of Endeavor

The present invention relates to the field of gas turbine technology, more specifically to a blade for a gas turbine, and to a method for producing such a blade.

2. Brief Description of the Related Art

The hot gas temperatures, which are becoming ever higher, in gas turbines make it necessary to not only produce the rotor blades and/or stator blades in use from special materials but also to cool the blades in an efficient manner using a cooling medium. In this case, the cooling medium is introduced into the interior of the blades, flows through cooling passages which are arranged in the walls, and discharges to the outside through film-cooling holes in order to form a cooling film on the outer side of the blade at the places which are thermally particularly loaded.

The current status of blade cooling technology is known from U.S. Pat. No. 6,379,118 B2, for example. Cooling passages in the walls are used there in combination with impingement cooling, turbulence-generating elements, backflow. and film cooling in order to keep the wall temperatures down so that a satisfactory service life of the components is achieved.

The prior art which is described in that patent has various disadvantages, however:

the spacing of the film-cooling holes cannot be freely selected in order to balance out the different cooling mechanisms (film cooling and internal cooling) because a strict sequence of cooling passages and film-cooling holes is observed;

there is no possibility of protecting the rear wall while introducing the film-cooling holes; and there is no existing method for the purpose of cooling the fillets between the blade airfoil and the platform, which are particularly critical for the service life.

SUMMARY

One of numerous aspects of the present invention includes a blade for a gas turbine which can be distinguished by significantly improved cooling.

Another aspect includes a method for producing such a blade.

Yet another aspect includes a blade for a gas turbine, which comprises a blade airfoil, the blade wall of which encloses an interior space, wherein, for cooling the blade wall, provision is made in said blade wall for a cooling arrangement which has a radial passage extending in the longitudinal direction of the blade and from which a multiplicity of cooling passages, extending in the blade wall, branch in the transverse direction, and from which a multiplicity of film-cooling holes are led to the outside in the transverse direction. The blade is distinguished by the fact that the distribution of the film-cooling holes along the radial passage is selected independently of the distribution of the cooling passages along the radial passage.

Another aspect includes that the radial passage is arranged in an offset manner towards the inside from the middle of the blade wall in order to enable a fan-like arrangement of the film-cooling holes. As a result of the offset, the wall region between the radial passage and the outer side is considerably thicker so that there is adequate wall material for the fan-like arrangement.

Another aspect is distinguished by the fact that the radial passage is accessible from the outside at one end and is sealed off there by a subsequently attached sealing element. This access from the outside makes it possible to insert a strip into the interior of the radial passage for protection of the inner walls when the blade is being machined.

A further aspect includes that the blade comprises a platform into which the blade airfoil merges at the lower end, and the radial passage is accessible from the outside at the transition between the blade airfoil and the platform. In this way, the sealable access lies in the inside of the blade.

Yet another aspect includes that the blade comprises a platform into which the blade airfoil merges at the lower end, forming a fillet, and in that cooling passages are provided in the region of the fillet for cooling the transition region. As a result of this, the particularly critical transition region is optimally cooled.

According to another aspect, turbulence elements, especially in the form of ribs or pins, are provided in the cooling passages for improving the cooling.

A further aspect includes that provision is made for impingement cooling holes which lead from the interior space of the blade to the cooling passages.

Another aspect is distinguished by the fact that cooling passages extend from the radial passage only on one side.

It is also conceivable, however, that cooling passages extend from the radial passage on both sides.

Yet another aspect includes methods for producing a blade with a radial passage which is accessible from the outside, and includes that in a first step, the blade is provided with a radial passage which is open on one side, in that in a second step, a strip-like insert is inserted into the open radial passage, in that in a third step, film-cooling holes are introduced into the blade from the outside, wherein the wall of the radial passage opposite the film-cooling holes is protected by the insert during the machining, and in that in a fourth step, the insert is removed from the radial passage.

Another aspect includes that the radial passage is sealed off with a sealing element after removing the insert.

In particular, the sealing element is hard-soldered.

Another aspect includes that the film-cooling holes are introduced by laser drilling, and that a PTFE strip is used as the insert.

BRIEF DESCRIPTION OF THE DRAWINGS

The subject matter of this application shall subsequently be explained in more detail based on exemplary embodiments in conjunction with the drawing. In the drawings.

DETAILED DESCRIPTION OF EXEMPLARY EMBODIMENTS

Figure 1:
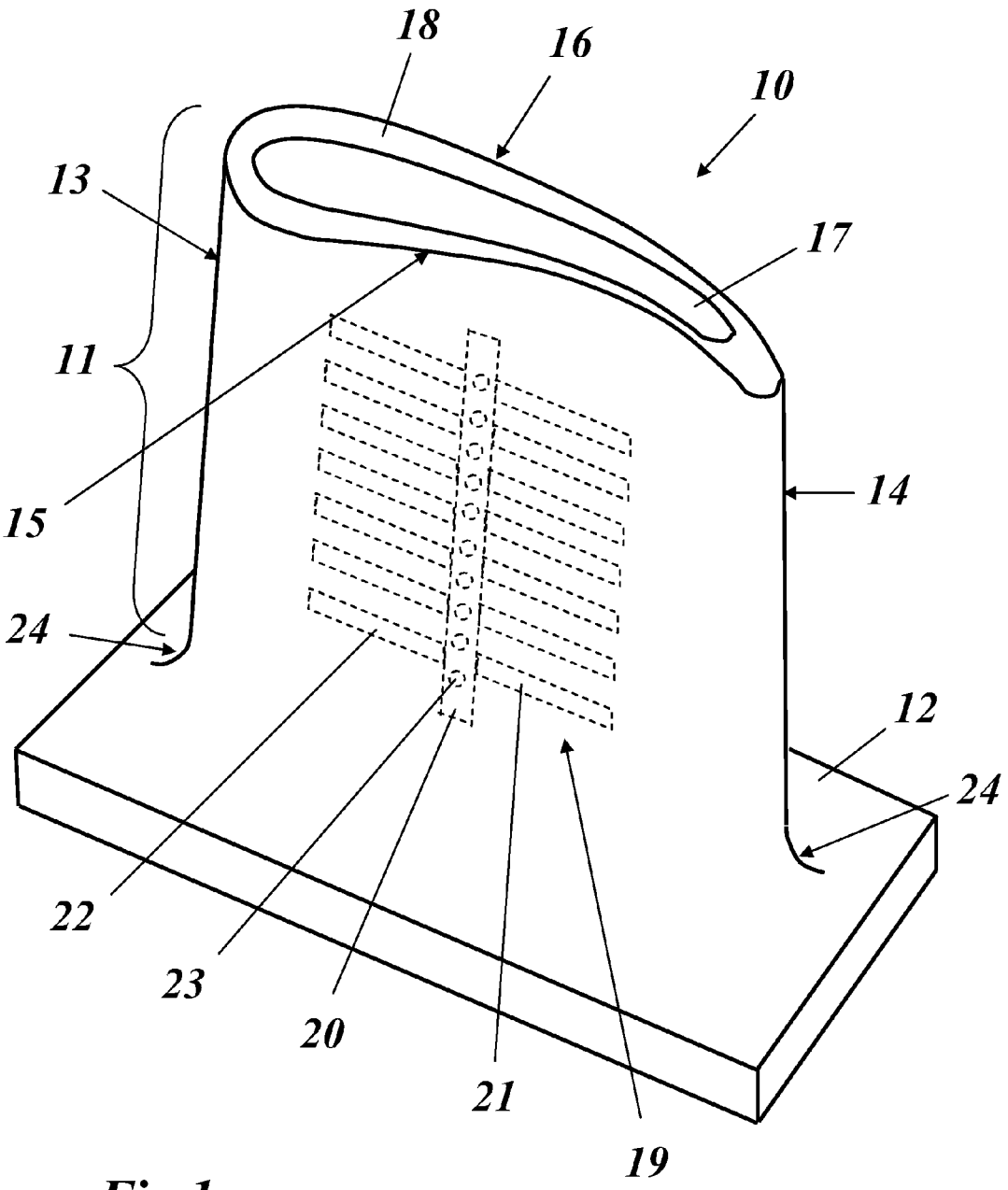
FIG. 1 shows, in a perspective side view, a gas turbine blade with a platform, in the wall of which blade provision is made for a cooling arrangement with a radial passage and cooling passages which project to the side.

The subject matter of this application deals with a blade for a gas turbine, as is shown by way of example in FIG. 1 in a perspective side view. The blade 10, which can be a rotor blade or a stator blade of the gas turbine, includes a blade airfoil 11 which, as is customary, has a leading edge 13, a trailing edge 14, a pressure side 15, and a suction side 16. The blade airfoil 11, which extends by its longitudinal axis in the radial direction, merges at the bottom into a platform, forming a fillet 24. The blade airfoil 11 has a blade wall 18 which encloses a hollow interior space 17. A cooling arrangement 19 (shown by dashed lines) is accommodated in the blade wall 18 and directs a cooling medium, e.g., cooling air, coming from the inside, through the wall, and then guides the cooling medium to the outside for forming a cooling film.

The cooling arrangement 19 in this example includes a central radial passage 20 from which cooling passages 21, 22 project equidistantly and on both sides. Furthermore, extending outwards from the radial passage 20 are film-cooling holes 23 through which the cooling medium discharges to the outside for forming a film. With this type of cooling arrangement, it can be advantageous that the distribution or density or periodicity of the film-cooling holes 23 is selected independently of the distribution or density or periodicity of the cooling passages 21, 22 in order to optimize the film cooling on the outer side of the blade 10 independently of the internal wall cooling.

Figure 2:
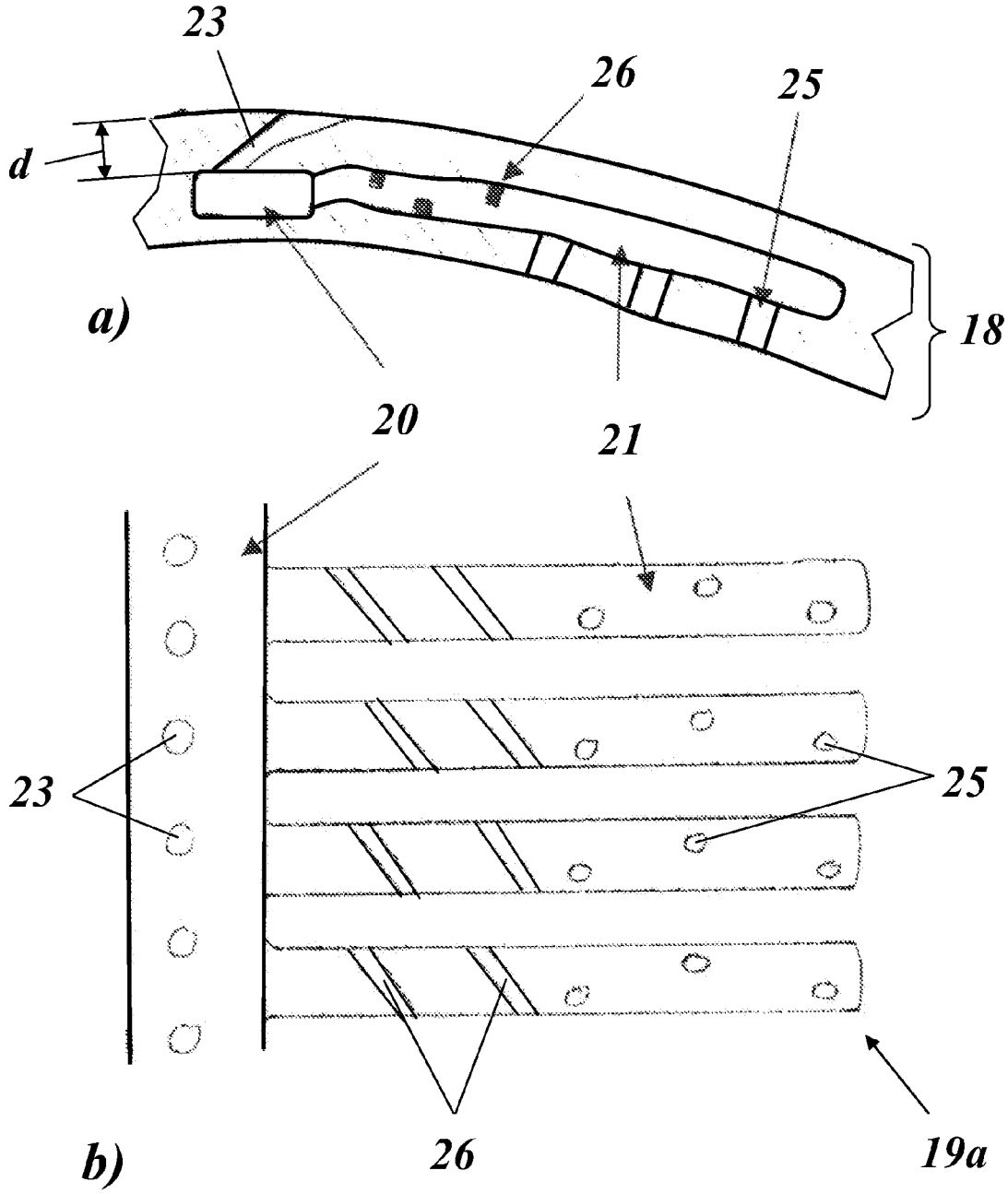
FIG. 2 shows a cross section through a blade wall with a cooling arrangement according to an exemplary embodiment of the invention (FIG. 2*a*) and the side view of the same cooling arrangement (FIG. 2*b*)

In FIG. 2, an exemplary embodiment of a cooling arrangement according to principles of the present invention is reproduced in cross section (FIG. 2*a*) and in side view (FIG. 2*b*). The cooling arrangement 19*a* has a radial passage 20 from which cooling passages 21 project equidistantly only towards one side. Turbulence elements 26, which are known per se, can be arranged in the cooling passages 21 in order to improve the heat transfer between the cooling medium and the wall by forming turbulences. The turbulence elements 26 can be designed in the form of ribs or pins, for example. Furthermore, provision can be made along the cooling passages 21 for impingement cooling holes 25 through which cooling medium flows from the interior space 17 of the blade 10 into the cooling passages 21 and impinges with cooling effect upon the opposite inner wall of the cooling passages 21.

As can be seen from FIG. 2*a*, the radial passage 20 is arranged in an offset manner towards the inside (downward in FIG. 2*a*) from the middle of the blade wall 18. As a result, the wall section is provided with a greater thickness d between the radial passage 20 and the outer side, which is necessary in order to enable a fan-like arrangement of the film-cooling holes 23 and therefore an improved forming of the cooling films on the outer side.

Figure 3:
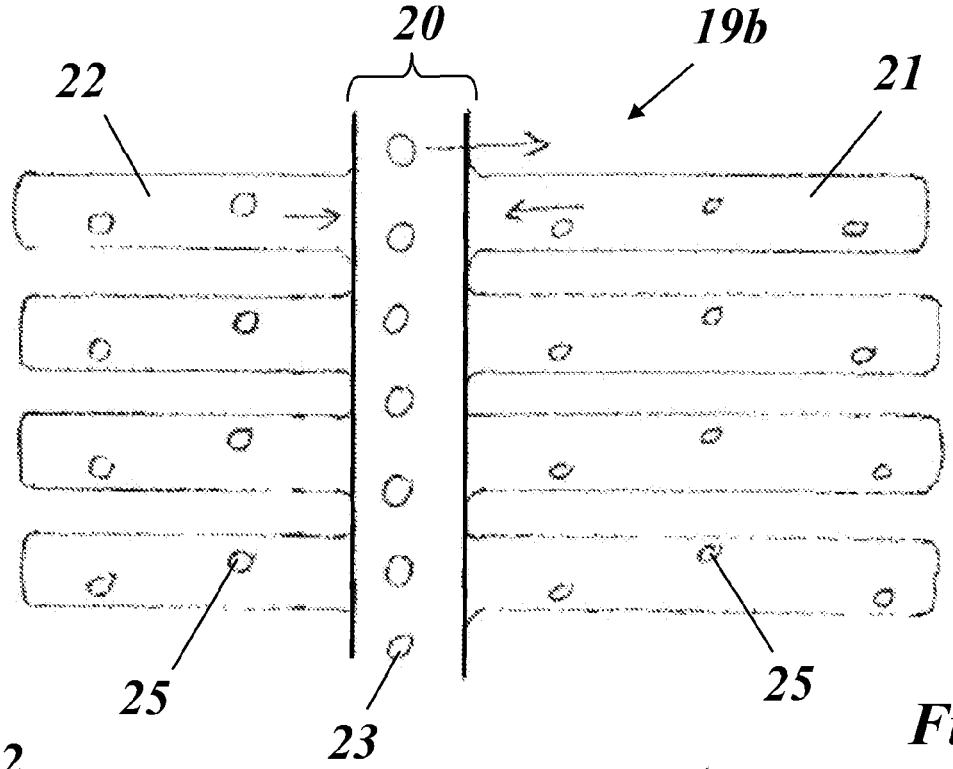
FIG. 3 shows, in a view comparable to FIG. 2*b*, a cooling arrangement with cooling passages which project from the radial passage on both sides.
Figure 4:
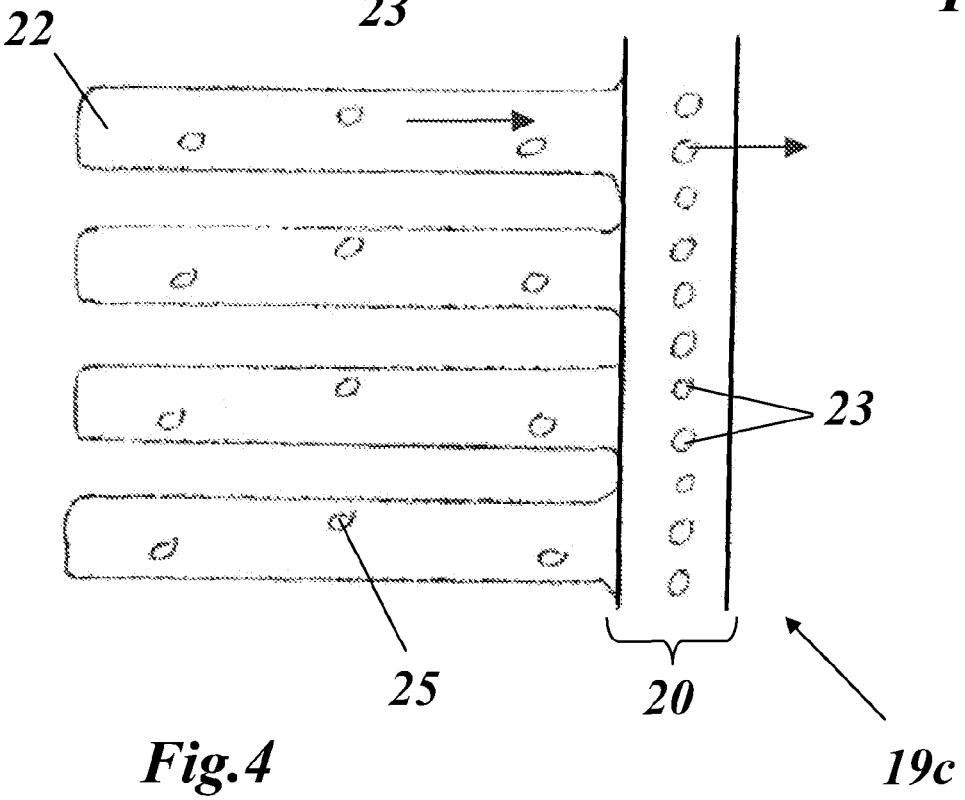
FIG. 4 shows, in a view comparable to FIG. 2*b*, a cooling arrangement with cooling passages which project from the radial passage on the other side and with a denser arrangement of film-cooling holes.

Other exemplary embodiments of cooling arrangements are reproduced in FIG. 3 and FIG. 4. The cooling arrangement 19*b* of FIG. 3 is distinguished by the fact that cooling passages 21 and 22 project from the central radial passage 20 on both sides and are equipped with corresponding impingement cooling holes 25. The arrangement of the cooling passages 21 and 22 projecting from the radial passage 20 on both sides need not necessarily be symmetrical in this case; the cooling passages 21 and 22 can therefore have a different distribution along the radial passage 20. The cooling arrangement 19*c* of FIG. 4 is distinguished by the fact that cooling passages 22 project from the radial passage 20 only on the other side, and that the film-cooling holes 23 have a particularly small spacing in the radial passage 20.

Figure 5:
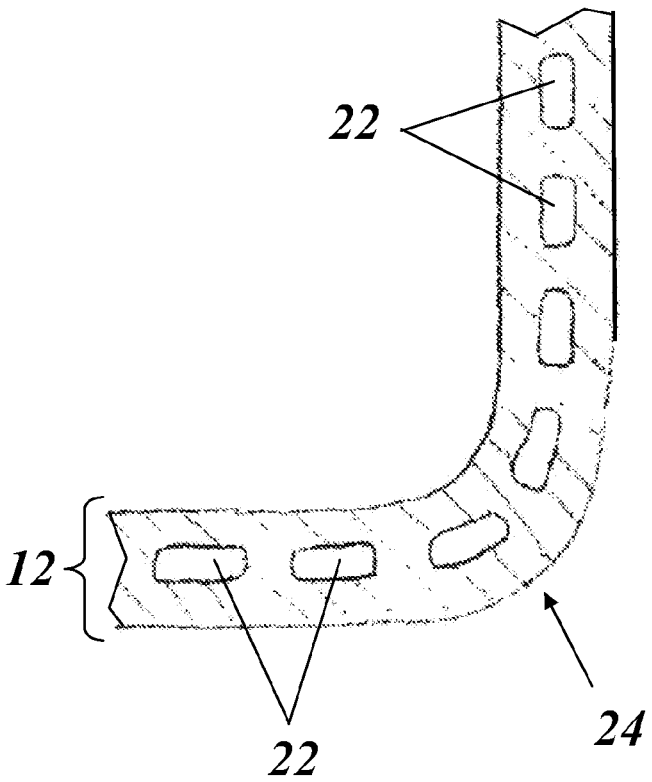
FIG. 5 shows a section through a blade at the transition between the blade airfoil and the platform with a cooling arrangement according to an exemplary embodiment of the invention.

As mentioned already, a special significance is given to the fillet 24 at the transition between the blade airfoil 11 and the platform 12 with regard to the cooling. Within the principles of the present invention, therefore, according to FIG. 5 provision is also made in the region of the fillet 24 in the blade wall 18 for cooling passages 22 which ensure adequate cooling in the critical region.

Figure 6:
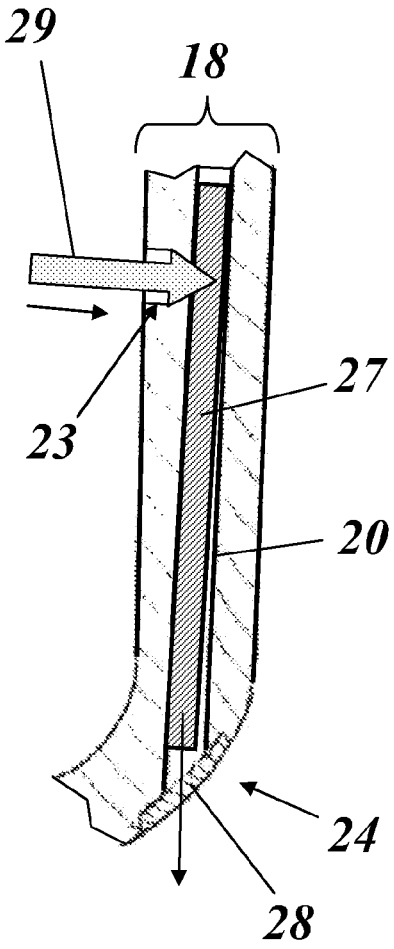
FIG. 6 shows a section through a blade at the transition between the blade airfoil and the platform with a radial passage which is accessible from the bottom and into which is inserted, according to an exemplary embodiment of the method according to the invention, an insert for the machining.

With regard to the production of the blade 10, it is advantageous if the radial passage 20 according to FIG. 6 is accessible from one side, especially from the bottom. According to the exemplary embodiment of FIG. 6, this is achieved by the radial passage 20 opening into the interior space of the blade in the region of the fillet 24 (in FIG. 6, this opening is already sealed off with a sealing element 28, which, however, happens only after introducing the film-cooling holes 23). If film-cooling holes 23 are to be formed in the blade from the outside, e.g., by laser drilling with a laser beam 29, a strip-like insert 27, which preferably is formed of PTFE, is first inserted through the bottom opening into the radial passage 20 in order to protect the opposite inner wall in the radial passage 20 when the holes are being drilled. After the film-cooling holes 23 have been introduced, the insert 27 is withdrawn from the radial passage 20 and the radial passage 20 is sealed off with the hard-soldered sealing element 28.

LIST OF DESIGNATIONS

10 Blade (stator blade or rotor blade)
11 Blade airfoil
12 Platform
13 Leading edge
14 Trailing edge
15 Pressure side
16 Suction side
17 Interior space
18 Blade wall
19, 19*a-c* Cooling arrangement
20 Radial passage
21, 22 Cooling passage
23 Film-cooling hole
24 Fillet
25 Impingement cooling hole
26 Turbulence element
27 Insert (strip-like)
28 Sealing element
29 Laser beam While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A blade for a gas turbine, comprising:

a blade airfoil having a blade wall which encloses an interior space;

wherein said blade wall comprises a cooling arrangement configured and arranged to cool the blade wall, the cooling arrangement including a radial passage extending in a longitudinal direction of the blade, a plurality of cooling passages extending in the blade wall from the radial passage and which branch out in a transverse direction, and a plurality of film-cooling holes extending transversely from the radial passage to outside the blade airfoil;

an opening in the blade wall through which the radial passage is accessible from the outside at one end; and a sealing element in the opening and sealing off the radial passage.

2. The blade as claimed in claim 1, wherein the radial passage is offset towards the inside of the blade airfoil from the middle of the blade wall.

3. The blade as claimed in claim 2, wherein the plurality of film-cooling holes forms a fan-like arrangement.

4. The blade as claimed in claim 1, comprising:

a platform into which the blade airfoil merges at a lower end; and wherein the radial passage is accessible from the outside at a transition between the blade airfoil and the platform.

5. The blade as claimed in claim 1, comprising:

a platform into which the blade airfoil merges at a lower end, forming a fillet; and cooling passages in the region of the fillet configured and arranged to cool the fillet.

6. The blade as claimed in claim 1, comprising:

turbulence elements in the plurality of cooling passages configured and arranged to improve cooling.

7. The blade as claimed in claim 6, wherein the turbulence elements comprise ribs or pins.

8. The blade as claimed in claim 1, comprising:

impingement cooling holes which lead from the interior space to the plurality of cooling passages.

9. The blade as claimed in claim 1, wherein the plurality of cooling passages extend only from the radial passage on one side.

10. The blade as claimed in claim 1, wherein the plurality of cooling passages extend from the radial passage on both sides.

11. A method for producing a blade for a gas turbine, the blade comprising a blade airfoil having a blade wall which encloses an interior space, wherein said blade wall comprises a cooling arrangement configured and arranged to cool the blade wall, the cooling arrangement including a radial passage extending in a longitudinal direction of the blade, a plurality of cooling passages extending in the blade wall from the radial passage and which branch out in a transverse direction, and a plurality of film-cooling holes extending transversely from the radial passage to outside the blade airfoil; wherein the distribution of the plurality of film-cooling holes along the radial passage is selected independently of the distribution of the plurality of cooling passages along the radial passage, an opening in the blade wall through which the radial passage is accessible from the outside at one end, and a sealing element in the opening and sealing off the radial passage, the method comprising:

providing the blade with the radial passage which is open on one side;

inserting a strip-like insert into the open radial passage;

forming film-cooling holes in the blade from the outside, wherein the wall of the radial passage opposite the film-cooling holes is protected by the insert during said forming; and removing the insert from the radial passage.

12. The method as claimed in claim 11, comprising:

sealing off the radial passage with the sealing element after removing the insert.

13. The method as claimed in claim 12, further comprising:

hard-soldering the sealing element.

14. The method as claimed in claim 11, wherein:

forming film-cooling holes comprises laser drilling; and inserting a strip-like insert comprises inserting a PTFE strip.

* * * * *